US012607387B2

(12) United States Patent
Yamada

(10) Patent No.: US 12,607,387 B2
(45) Date of Patent: Apr. 21, 2026

(54) REFRIGERATION DEVICE

(71) Applicant: Panasonic Intellectual Property Management Co., Ltd., Osaka (JP)

(72) Inventor: Yuya Yamada, Saitama (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 133 days.

(21) Appl. No.: 18/728,001

(22) PCT Filed: Nov. 28, 2022

(86) PCT No.: PCT/JP2022/043686

§ 371 (c)(1),
(2) Date: Jul. 10, 2024

(87) PCT Pub. No.: WO2023/135956

PCT Pub. Date: Jul. 20, 2023

(65) Prior Publication Data

US 2025/0109892 A1 Apr. 3, 2025

(30) Foreign Application Priority Data

Jan. 14, 2022 (JP) ..... 2022-004032

(51) Int. Cl.
*F25B 6/02* (2006.01)
*F25B 9/00* (2006.01)
(Continued)

(52) U.S. Cl.
CPC ..... *F25B 6/02* (2013.01); *F25B 9/008* (2013.01); *F25B 39/00* (2013.01); *F25B 49/027* (2013.01);
(Continued)

(58) Field of Classification Search
CPC .. F25B 6/02; F25B 9/008; F25B 39/00; F25B 49/027; F25B 39/04; F25B 2339/047
See application file for complete search history.

(56) References Cited

U.S. PATENT DOCUMENTS

2009/0120110 A1 5/2009 Grabon et al.

FOREIGN PATENT DOCUMENTS

DE 102016002113 A1 * 8/2017 ..... B60H 1/3214
EP 3872413 A1 9/2021
(Continued)

OTHER PUBLICATIONS

FOR1, Method For Determining the Oil Circulation Rate OCR of a Refrigerant Oil Mixture in a Refrigerant Circuit of a Vehicle Air Conditioning System, 2017, Full Document (Year: 2017).*
(Continued)

*Primary Examiner* — Nael N Babaa
(74) *Attorney, Agent, or Firm* — Rimon P.C.

(57) ABSTRACT

A refrigeration device according to the present disclosure is operated by switching the gas cooler to be used, and comprises a refrigerant circuit configured from a compression mechanism, a water-cooled gas cooler and an air-cooled gas cooler for cooling a refrigerant discharged from the compression mechanism, an expansion mechanism, and an evaporator, wherein, during a water-cooling operation in which the water-cooled gas cooler is used, excess refrigerant is recovered in the air-cooled gas cooler, thereby adjusting the amount of circulated refrigerant in the refrigerant circuit.

5 Claims, 3 Drawing Sheets

(51) Int. Cl.
*F25B 39/00* (2006.01)
*F25B 49/02* (2006.01)
*F25B 39/04* (2006.01)

(52) U.S. Cl.
CPC ..... *F25B 39/04* (2013.01); *F25B 2339/047* (2013.01)

(56) References Cited

FOREIGN PATENT DOCUMENTS

| | | | |
|---|---|---|---|
| JP | S55-108358 | U | 4/1984 |
| JP | H04-055670 | A | 2/1992 |
| JP | 2020-118354 | A | 8/2020 |
| JP | 2021-134954 | A | 9/2021 |
| WO | 2016/084175 | A1 | 6/2016 |

OTHER PUBLICATIONS

Extended European Search Report dated Mar. 19, 2025 issued in the corresponding European Patent Application No. 22920476.3.
International Search Report dated Jan. 10, 2023 issued in International Patent Application No. PCT/JP2022/043686, with English translation.

* cited by examiner

REFRIGERATION DEVICE

CROSS-REFERENCE OF RELATED APPLICATIONS

This application is the U.S. National Phase under 35 U.S.C. § 371 of International Patent Application No. PCT/JP2022/043686, filed on Nov. 28, 2022, which in turn claims the benefit of Japanese Patent Application No. 2022-004032, filed on Jan. 14, 2022, the entire disclosures of which Applications are incorporated by reference herein.

TECHNICAL FIELD

The present disclosure relates to a refrigeration device to be connected to a refrigerating or freezing showcase or the like and relates, in particular, to a refrigeration device in which waste heat of the refrigeration device can be used for hot-water supply and heating.

BACKGROUND ART

PTL 1 discloses a condensing unit in which waste heat of a refrigeration device can be used for hot-water supply and heating. The condensing unit includes a water-cooling-type gas cooler and an air-cooling-type gas cooler.

CITATION LIST

Patent Literature

PTL 1

Japanese Patent Application Laid-Open No. 2020-118354

SUMMARY OF INVENTION

Technical Problem

The present disclosure provides a refrigeration device capable of maintaining a proper circulation refrigerant amount in a refrigerant circuit and preventing an abnormal increase in a high-pressure-side pressure.

Solution to Problem

A refrigeration device in the present disclosure is a refrigeration device that operates while switching a gas cooler to be used, the refrigeration device including: a refrigerant circuit that is constituted by a compression mechanism, a water-cooling-type gas cooler and an air-cooling-type gas cooler that cool a refrigerant that has been discharged from the compression mechanism, an expansion mechanism, and an evaporator, in which a circulation refrigerant amount in the refrigerant circuit is adjusted by collecting an excessive refrigerant into the air-cooling-type gas cooler during a water-cooling operation in which the water-cooling-type gas cooler is used.

Advantageous Effects of Invention

The refrigeration device in the present disclosure can maintain a proper circulation refrigerant amount in a refrigerant circuit. It is thus possible to prevent an abnormal increase in the high-pressure-side pressure.

DESCRIPTION OF EMBODIMENTS (Underlying Knowledge and the like Forming Basis of the Present Disclosure)

At the time when the present disclosure was conceived by the inventor, waste heat of refrigeration devices has been desired to be used for hot-water supply and heating in stores such as convenience stores and supermarkets. With the water-cooling-type gas cooler and the air-cooling-type gas cooler, the condensing unit in PTL 1 enables usage of waste heat for hot-water supply and heating by being switched between a water-cooling operation and an air-cooling operation. However, since the heat transfer coefficient of air is smaller than the heat transfer coefficient of water, the air-cooling-type gas cooler has a larger size than the water-cooling-type gas cooler. Therefore, the air-cooling-type gas cooler and the water-cooling-type gas cooler greatly differ from each other in terms of required refrigerant amount. The inventor has found a problem that the circulation refrigerant amount in a refrigerant circuit thus becomes excessive during the water-cooling operation and causes an abnormal increase in a high-pressure-side pressure, and has made a theme of the present disclosure to solve the problem.

Hereinafter, an embodiment will be described in detail with reference to the drawings. However, detailed description more than necessary may be omitted. For example, detailed description of already well-known matters or duplicated description of substantially identical configurations may be omitted.

Note that the accompanying drawings and the following description are provided for a person skilled in the art to sufficiently understand the present disclosure and are not intended to limit the theme disclosed in the claims.

Embodiment 1

Hereinafter, Embodiment 1 will be described with FIG. 1.

[1-1. Configuration]

Figure 1:
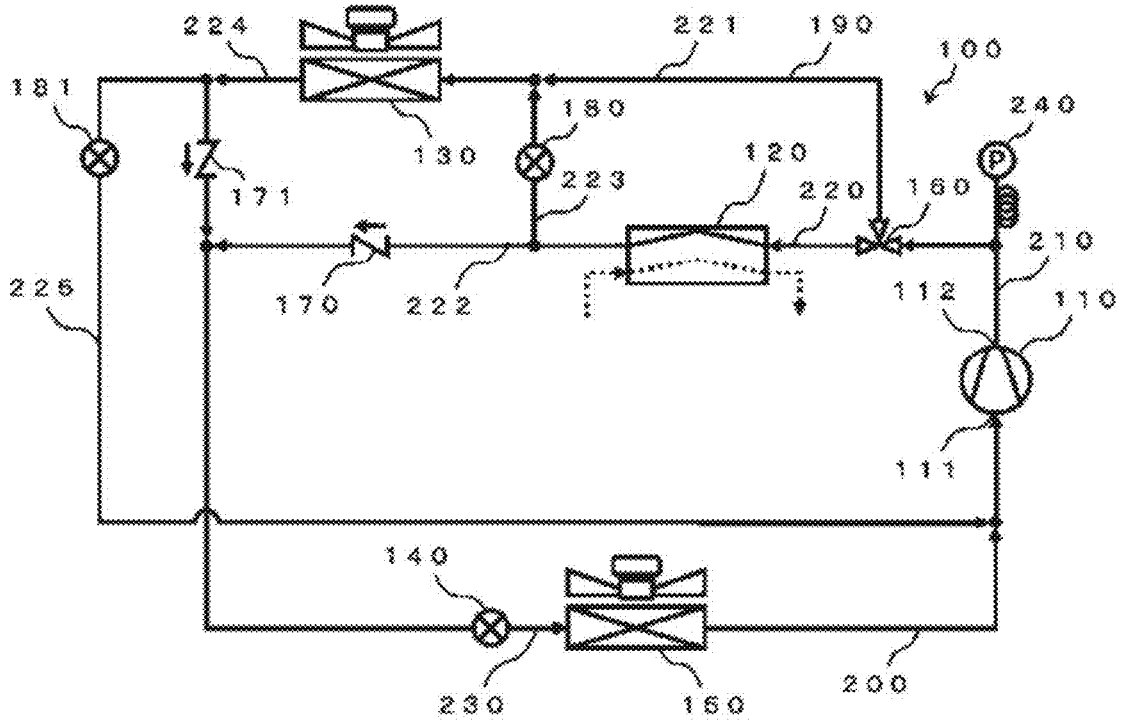
FIG. 1 is a refrigerant circuit diagram of a refrigeration device in Embodiment 1.

In FIG. 1, refrigeration device 100 includes compression mechanism 110; water-cooling-type gas cooler 120 and air-cooling-type gas cooler 130 that cool a refrigerant that has been discharged from compression mechanism 110; expansion mechanism 140 that decompresses the cooled refrigerant; and evaporator 150 that absorbs heat from a heat source, such as air.

Compression mechanism 110 has intake port 111 and discharge port 112.

Refrigeration device 100 is switchable between a water-cooling operation and an air-cooling operation and includes refrigerant-passage switching mechanism 160 that switches to cause the refrigerant that has been discharged from compression mechanism 110 to flow into water-cooling-type gas cooler 120 or to flow into air-cooling-type gas cooler 130; first backflow preventing mechanism 170 that prevents the refrigerant that has flowed out from air-cooling-type gas cooler 130 from flowing backward to water-cooling-type gas cooler 120; and second backflow preventing mechanism 171 that prevents the refrigerant that has flowed out from water-cooling-type gas cooler 120 from flowing backward to air-cooling-type gas cooler 130.

Refrigeration device 100 further includes first refrigerant flow-rate adjusting mechanism 180 and second refrigerant flow-rate adjusting mechanism 181 to maintain a proper circulation refrigerant amount in a refrigerant circuit.

In the present embodiment, a three-way electromagnetic valve is used in refrigerant-passage switching mechanism 160. A check valve is used in each of first backflow preventing mechanism 170 and second backflow preventing mechanism 171. An electronic expansion valve is used in each of first refrigerant flow-rate adjusting mechanism 180 and second refrigerant flow-rate adjusting mechanism 181.

These devices that constitute refrigeration device 100 are connected to each other by refrigerant pipe 190 through which the refrigerant flows.

Refrigerant pipe 190 is constituted by intake pipe 200 that connects evaporator 150 to intake port 111; discharge pipe 210 that connects discharge port 112 to an inlet of refrigerant-passage switching mechanism 160; first high-pressure pipe 220 that connects one of outlets of refrigerant-passage switching mechanism 160 to water-cooling-type gas cooler 120; second high-pressure pipe 221 that connects another one of the outlets of the refrigerant-passage switching mechanism 160 to air-cooling-type gas cooler 130; third high-pressure pipe 222 that connects water-cooling-type gas cooler 120 to expansion mechanism 140 via first backflow preventing mechanism 170; fourth high-pressure pipe 224 that connects air-cooling gas cooler 130 to third high-pressure pipe 222 via second backflow preventing mechanism 171; refrigerant bypass pipe 223 that branches from third high-pressure pipe 222 and joins/connects with second high-pressure pipe 221 via first refrigerant flow-rate adjusting mechanism 180; injection pipe 225 that branches from fourth high-pressure pipe 224 and joins/connects with intake pipe 200 via second refrigerant flow-rate adjusting mechanism 181; and evaporator inlet pipe 230 that connects expansion mechanism 140 to evaporator 150.

Discharge pipe 210 is provided with high-pressure-side pressure sensor 240 that detects a refrigerant pressure on the high-pressure side.

Refrigeration device 100 also includes a controller (not illustrated) that controls units integrally.

In refrigeration device 100 in the present embodiment, carbon dioxide, with which the refrigerant pressure on the high-pressure side becomes higher than or equal to a critical pressure (supercritical), is used as the refrigerant. The carbon dioxide refrigerant is a non-flammable and non-toxic natural refrigerant that has a less environmental load.

Here, refrigeration device 100 is filled with the refrigerant such that the amount of the refrigerant is proper during the air-cooling operation, in which air-cooling-type gas cooler 130 is used.

[1-2. Actions]

Actions and operations of refrigeration device 100 that is configured as described above will be described below.

Refrigeration device 100 is switchable between the water-cooling operation and the air-cooling operation.

Actions of the refrigerant during the water-cooling operation, in which water-cooling-type gas cooler 120 is used, will be first described.

First, compression mechanism 110 is actuated to thereby cause the refrigerant that has returned from evaporator 150 to be drawn into compression mechanism 110 via intake port 111.

The refrigerant that has been drawn into compression mechanism 120 is compressed to a high-pressure-side pressure and is discharged through discharge port 112.

The refrigerant that has been discharged through discharge port 112 flows into refrigerant-passage switching mechanism 160 via discharge pipe 210.

During the water-cooling operation, refrigerant-passage switching mechanism 160 is actuated such that the outlet on the side of first high-pressure pipe 220 is in an opened state and the outlet on the side of second high-pressure pipe 221 is in a closed state.

Therefore, the refrigerant that has flowed into refrigerant-passage switching mechanism 160 flows into water-cooling-type gas cooler 120 via first high-pressure pipe 220.

The refrigerant that has flowed into water-cooling-type gas cooler 120 is cooled by exchanging heat with water and then flows into expansion mechanism 140 via third high-pressure pipe 222 and first backflow preventing mechanism 170.

The refrigerant that has flowed into expansion mechanism 140 is decompressed to a predetermined low-pressure-side pressure and then is sent to evaporator 150 via evaporator inlet pipe 230.

The refrigerant that has been sent to evaporator 150 is heated by exchanging heat with air in, for example, a refrigerating showcase and is drawn again into compression mechanism 110.

Then, these actions of the refrigerant are repeated while compression mechanism 110 is actuated.

Here, refrigeration device 100 can adjust the circulation refrigerant amount in the refrigerant circuit by collecting an excessive refrigerant into air-cooling-type gas cooler 130 during the water-cooling operation.

When the circulation refrigerant amount in the refrigerant circuit is excessive, first refrigerant flow-rate adjusting mechanism 180 is actuated to cause part of the refrigerant cooled in water-cooling-type gas cooler 120 to flow into air-cooling-type gas cooler 130 via third high-pressure pipe 222, refrigerant bypass pipe 223, first refrigerant flow-rate adjusting mechanism 180, and second high-pressure pipe 221. This is called refrigerant collecting action.

The refrigerant that has flowed into air-cooling gas cooler 130 exchanges heat with air around air-cooling gas cooler 130 through natural convection and stagnates due to a saturation pressure corresponding to the ambient temperature of air-cooling gas cooler 130. Normally, the refrigerant pressure on the high-pressure side is set to be higher than the saturation pressure corresponding to the ambient temperature of air-cooling gas cooler 130. Thus, the refrigerant that stagnates at air-cooling gas cooler 130 does not passively flow out.

However, when the ambient temperature of air-cooling-type gas cooler 130 becomes a high temperature and the saturation pressure corresponding to the ambient temperature of air-cooling gas cooler 130 exceeds the refrigerant pressure on the high-pressure side, the refrigerant that stagnates at air-cooling gas cooler 130 merges with a refrigerant in third high-pressure pipe 222 via fourth high-pressure pipe 224 and second backflow preventing mechanism 171. Thus, an abnormal increase in the pressure of air-cooling gas cooler 130 due to so-called liquid seal does not occur.

Meanwhile, when the amount of the refrigerant that stagnates at air-cooling gas cooler 130 is increased and the circulation refrigerant amount in the refrigerant circuit becomes insufficient, second refrigerant flow-rate adjusting mechanism 181 is actuated to cause the refrigerant that stagnates at air-cooling-type gas cooler 130 to merge with a refrigerant in intake pipe 200 via fourth high-pressure pipe 224, injection pipe 225, and second refrigerant flow-rate adjusting mechanism 181. This is called refrigerant releasing action.

In the present embodiment, the controller (not illustrated) performs the refrigerant collecting action or the refrigerant releasing action on the basis of a detection value obtained by high-pressure-side pressure sensor 240 such that the circulation refrigerant amount in the refrigerant circuit becomes proper.

When the refrigerant pressure on the high-pressure side is higher than a predetermined value, in other words, the circulation refrigerant amount in the refrigerant circuit is excessive, the controller (not illustrated) determines whether second refrigerant flow-rate adjusting mechanism 181 is fully closed.

Then, when determined that second refrigerant flow-rate adjusting mechanism 181 is fully closed, the controller (not illustrated) controls first refrigerant flow-rate adjusting mechanism 180 such that the amount of the refrigerant that flows via first refrigerant flow-rate adjusting mechanism 180 is increased.

When it is determined that second refrigerant flow-rate adjusting mechanism 181 is not fully closed, second refrigerant flow-rate adjusting mechanism 181 is controlled such that second refrigerant flow-rate adjusting mechanism 181 is fully closed.

Meanwhile, when the refrigerant pressure on the high-pressure side is lower than the predetermined value, in other words, the circulation refrigerant amount in the refrigerant circuit is insufficient, the controller (not illustrated) determines whether first refrigerant flow-rate adjusting mechanism 180 is fully closed.

Then, when determined that first refrigerant flow-rate adjusting mechanism 180 is fully closed, the controller (not illustrated) controls second refrigerant flow-rate adjusting mechanism 181 such that the amount of the refrigerant that flows via second refrigerant flow-rate adjusting mechanism 181 is increased.

When it is determined that first refrigerant flow-rate adjusting mechanism 180 is not fully closed, first refrigerant flow-rate adjusting mechanism 180 is controlled such that first refrigerant flow-rate adjusting mechanism 180 is fully closed.

Next, actions of the refrigerant during the air-cooling operation, in which air-cooling-type gas cooler 130 is used, will be described.

First, compression mechanism 110 is actuated to thereby cause the refrigerant that has returned from evaporator 150 to be drawn into compression mechanism 110 via intake port 111.

The refrigerant that has been drawn into compression mechanism 120 is compressed to the high-pressure-side pressure and is discharged through discharge port 112.

The refrigerant that has been discharged through discharge port 112 flows into refrigerant-passage switching mechanism 160 via discharge pipe 210.

During the air-cooling operation, refrigerant-passage switching mechanism 160 is actuated such that the outlet on the side of first high-pressure pipe 220 is in a closed state and the outlet on the side of second high-pressure pipe 221 is in an opened state.

Therefore, the refrigerant that has flowed into refrigerant-passage switching mechanism 160 flows into air-cooling-type gas cooler 130 via second high-pressure pipe 221.

The refrigerant that has flowed into air-cooling-type gas cooler 130 is cooled by exchanging heat with air and then flows into expansion mechanism 140 via fourth high-pressure pipe 224, second backflow preventing mechanism 171, and third high-pressure pipe 222.

The refrigerant that has flowed into expansion mechanism 140 is decompressed to a predetermined low-pressure-side pressure and then is sent to evaporator 150 via evaporator inlet pipe 230.

The refrigerant that has been sent to evaporator 150 is heated by exchanging heat with air in, for example, a refrigerating showcase and is drawn again into compression mechanism 110.

Then, these actions of the refrigerant are repeated while compression mechanism 110 is actuated.

Here, since refrigeration device 100 is filled with the refrigerant such that the amount of the refrigerant is proper during the air-cooling operation, the circulation refrigerant amount in the refrigerant circuit is not required to be adjusted during the air-cooling operation.

[1-3. Effects and the Like]

As described above, refrigeration device 100 in the present embodiment is a refrigeration device in which the refrigerant circuit is constituted by compression mechanism 110, water-cooling-type gas cooler 120 and air-cooling-type gas cooler 130 that cool the refrigerant that has been discharged from compression mechanism 110, expansion mechanism 140, and evaporator 150. The refrigeration device operates while switching a gas cooler to be used, and the circulation refrigerant amount in the refrigerant circuit is adjusted by collecting an excessive refrigerant into air-cooling-type gas cooler 130 during the water-cooling operation, in which water-cooling-type gas cooler 120 is used.

Consequently, it is possible to maintain a proper circulation refrigerant amount in the refrigerant circuit. It is thus possible to prevent an abnormal increase in the high-pressure-side pressure.

In addition, as in the present embodiment, high-pressure-side pressure sensor 240 that detects the refrigerant pressure on the high-pressure side may be included, and the circulation refrigerant amount in the refrigerant circuit may be adjusted by performing, in response to an increase in the refrigerant pressure on the high-pressure side, the refrigerant collecting action, in which the refrigerant is collected from the high-pressure side of the refrigerant circuit into air-cooling-type gas cooler 130, and performing, in response to a decrease in the refrigerant pressure on the high-pressure side, the refrigerant releasing action, in which the refrigerant is released from air-cooling-type gas cooler 130 to the low-pressure side of the refrigerant circuit.

Consequently, it is possible to maintain a predetermined high-pressure-side pressure. It is thus possible to suppress a decrease in the coefficient of performance (COP) due to an increase in power consumption of compression mechanism 110.

In addition, as in the present embodiment, refrigerant bypass pipe 223 that connects a connection pipe on the downstream side of water-cooling-type gas cooler 120 to a connection pipe on the upstream side or the downstream side of air-cooling-type gas cooler 130 may be included, and the circulation refrigerant amount in the refrigerant circuit may be adjusted by performing the refrigerant collecting action via refrigerant bypass pipe 223.

Consequently, it is possible to reduce the time required for the collected refrigerant to exchange heat with air around air-cooling gas cooler 130 and reach a saturation pressure corresponding to the ambient temperature of air-cooling gas cooler 130. It is thus possible to more efficiently collect the refrigerant in the refrigerant collecting action and possible to adjust the circulation refrigerant amount in the refrigerant circuit in a shorter time.

In addition, as in the present embodiment, carbon dioxide may be used as the refrigerant in refrigeration device 100.

Consequently, a temperature glide increases in the process of heat dissipation on the high-pressure side, and it is thus possible to improve efficiency in a heat exchange through a counter flow. Therefore, it is possible to more efficiently generate waste heat having a high temperature and possible to use the waste heat for hot-water supply and heating.

Embodiment 2

Hereinafter, Embodiment 2 will be described with FIG. 2.

[2-1. Configuration]

Figure 2:
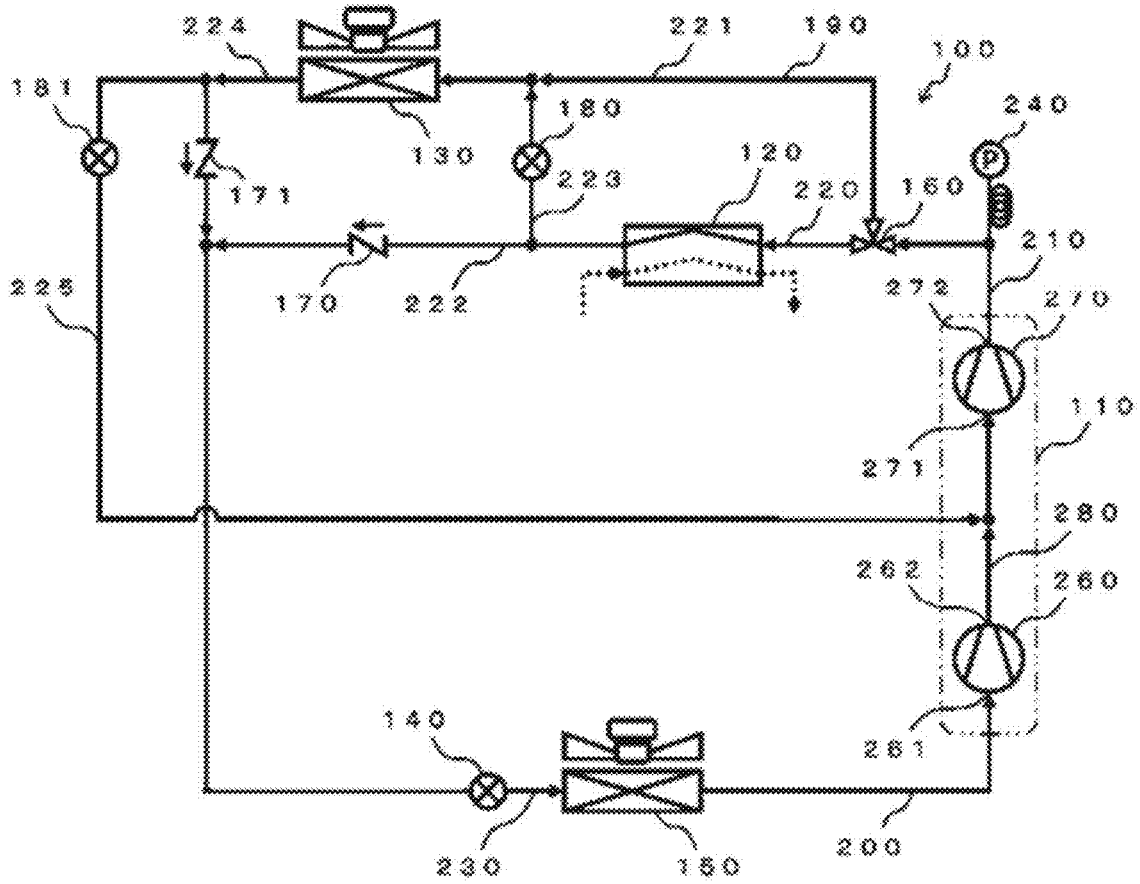
FIG. 2 is a refrigerant circuit diagram of a refrigeration device in Embodiment 2.

In FIG. 2, refrigeration device 100 includes, as compression mechanism 110, low-stage compression mechanism 260 and high-stage compression mechanism 270.

Low-stage compression mechanism 260 has low-stage intake port 261 and low-stage discharge port 262. High-stage compression mechanism 270 has high-stage intake port 271 and high-stage discharge port 272.

Other devices that constitute refrigeration device 100 are the same as those in Embodiment 1, and description of identical portions is thus omitted by giving identical signs thereto.

In the present embodiment, refrigerant pipe 190 is constituted by, in addition to those in Embodiment 1, intermediate-pressure pipe 280 that connects low-stage discharge port 262 and high-stage intake port 271 to each other.

In addition, the present embodiment is configured such that intake pipe 200 connects evaporator 150 to low-stage intake port 261, discharge pipe 210 connects high-stage discharge port 272 to refrigerant-passage switching mechanism 160, and injection pipe 225 branches from fourth high-pressure pipe 224 and merges/connects with intermediate-pressure pipe 280 via second refrigerant flow-rate adjusting mechanism 181.

[2-2. Actions]

Actions and operations of refrigeration device 100 that is configured as described above will be described below.

Refrigeration device 100 is switchable between the water-cooling operation and the air-cooling operation.

Actions of the refrigerant common between the water-cooling operation and the air-cooling operation will be first described.

First, compression mechanism 110 is actuated to thereby cause the refrigerant that has returned from evaporator 150 to be drawn into low-stage compression mechanism 260 via low-stage intake port 261.

The refrigerant that has been drawn into low-stage compression mechanism 260 is compressed to an intermediate pressure and is discharged through low-stage discharge port 262.

The refrigerant that has been discharged through low-stage discharge port 262 is drawn into high-stage compression mechanism 270 via intermediate-pressure pipe 280 and high-stage intake port 271 sequentially.

The refrigerant that has been drawn into high-stage compression mechanism 270 is compressed to the high-pressure-side pressure and is discharged through high-stage discharge port 272.

The refrigerant that has been discharged through high-stage discharge port 272 flows into refrigerant-passage switching mechanism 160 via discharge pipe 210.

Actions of the refrigerant thereafter are the same as those in Embodiment 1 in each of the water-cooling operation and the air-cooling operation, and description thereof is thus omitted.

In the refrigerant releasing action in the present embodiment, second refrigerant flow-rate adjusting mechanism 181 is actuated to thereby cause the refrigerant that stagnates at air-cooling-type gas cooler 130 to merge with a refrigerant in intermediate-pressure pipe 280 via fourth high-pressure pipe 224, injection pipe 225, and second refrigerant flow-rate adjusting mechanism 181.

Actions of the controller (not illustrated) are also the same as those in Embodiment 1, and description thereof is thus omitted.

[2-3. Effects and the Like]

As described above, refrigeration device 100 in the present embodiment is a refrigeration device in which the refrigerant circuit is constituted by compression mechanism 110, water-cooling-type gas cooler 120 and air-cooling-type gas cooler 130 that cool the refrigerant that has been discharged from compression mechanism 110, expansion mechanism 140, and evaporator 150. The refrigeration device operates while switching a gas cooler to be used, and the circulation refrigerant amount in the refrigerant circuit is adjusted by collecting an excessive refrigerant into air-cooling-type gas cooler 130 during the water-cooling operation, in which water-cooling-type gas cooler 120 is used.

Consequently, it is possible to maintain a proper circulation refrigerant amount in the refrigerant circuit. It is thus possible to prevent an abnormal increase in the high-pressure-side pressure.

In addition, as in the present embodiment, refrigeration device 100 may be a two-stage compression-type refrigeration device that includes, as compression mechanism 110, low-stage compression mechanism 260 and high-stage compression mechanism 270 and may include intermediate-pressure pipe 280 that connects low-stage compression mechanism 260 and high-stage compression mechanism 270 to each other and injection pipe 225 that connects the connection pipe on the upstream side or the downstream side of air-cooling-type gas cooler 130 and intermediate-pressure pipe 280 to each other, and the circulation refrigerant amount in the refrigerant circuit may be adjusted by performing the refrigerant releasing action via injection pipe 225.

Consequently, it is possible to reduce the influence of the refrigerant releasing action on the low-pressure-side pressure. It is thus possible to prevent hunting, in which a suction superheat degree periodically fluctuates.

Embodiment 3

Hereinafter, Embodiment 3 will be described with FIG. 3.

[3-1. Configuration]

Figure 3:
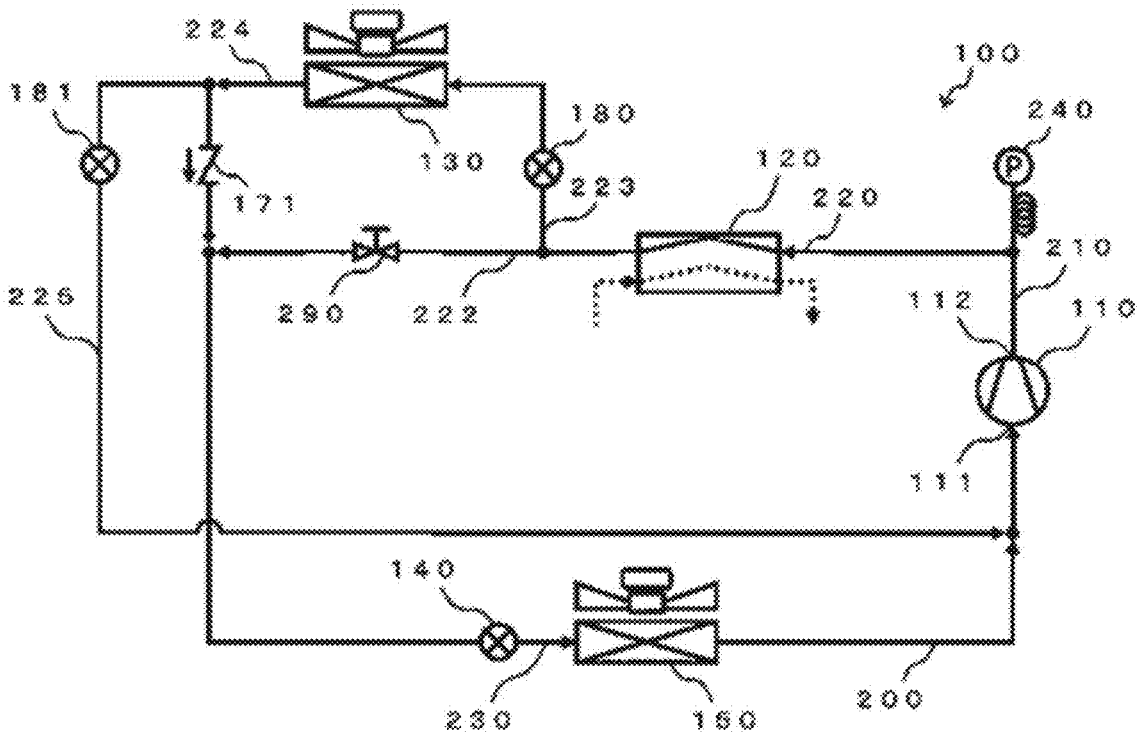
FIG. 3 is a refrigerant circuit diagram of a refrigeration device in Embodiment 3.

In FIG. 3, refrigeration device 100 includes refrigerant short-circuit mechanism 290 for switching between the water-cooling operation and the air-cooling operation.

In the present embodiment, an electromagnetic valve is used in refrigerant short-circuit mechanism 290.

Other devices that constitute refrigeration device 100 are the same as those in Embodiment 1, and description of identical portions is thus omitted by giving identical signs thereto.

The present embodiment is configured such that discharge pipe 210 connects discharge port 112 to water-cooling-type gas cooler 120, third high-pressure pipe 222 connects water-cooling-type gas cooler 120 to expansion mechanism 140 via refrigerant short-circuit mechanism 290, and refrigerant bypass pipe 223 branches from third high-pressure pipe 222 and connects with air-cooling-type gas cooler 130 via first refrigerant flow-rate adjusting mechanism 180.

[3-2. Actions]

Actions and operations of refrigeration device 100 that is configured as described above will be described below.

Refrigeration device 100 is switchable between the water-cooling operation and the air-cooling operation.

Actions of the refrigerant during the water-cooling operation, in which water-cooling-type gas cooler 120 is used, will be first described. During the water-cooling operation, refrigerant short-circuit mechanism 290 is actuated to be an opened state.

First, compression mechanism 110 is actuated to thereby cause the refrigerant that has returned from evaporator 150 to be drawn into compression mechanism 110 via intake port 111.

The refrigerant that has been drawn into compression mechanism 120 is compressed to the high-pressure-side pressure and is discharged through discharge port 112.

The refrigerant that has been discharged through discharge port 112 flows into water-cooling-type gas cooler 120 via discharge pipe 210.

The refrigerant that has flowed into water-cooling-type gas cooler 120 is cooled by exchanging heat with water and then flows into expansion mechanism 140 via third high-pressure pipe 222 and refrigerant short-circuit mechanism 290.

Actions of the refrigerant and actions of the controller (not illustrated) thereafter are the same as those in Embodiment 1, and description thereof is thus omitted.

In addition, actions of the controller (not illustrated) are also the same as those in Embodiment 1, and description thereof is thus omitted.

Next, actions of the refrigerant during the air-cooling operation, in which air-cooling-type gas cooler 130 is used, will be described. During the air-cooling operation, refrigerant short-circuit mechanism 290 is actuated to be in a closed state. In addition, during the air-cooling operation, first refrigerant flow-rate adjusting mechanism 180 is actuated to be in a fully opened state constantly.

First, compression mechanism 110 is actuated to thereby cause the refrigerant that has returned from evaporator 150 to be drawn into compression mechanism 110 via intake port 111.

The refrigerant that has been drawn into compression mechanism 120 is compressed to the high-pressure-side pressure and is discharged through discharge port 112.

The refrigerant that has been discharged through discharge port 112 flows into water-cooling-type gas cooler 120 via discharge pipe 210.

During the air-cooling operation, water is not supplied to water-cooling-type gas cooler 120. Therefore, the refrigerant that has flowed into water-cooling-type gas cooler 120 flows into third high-pressure pipe 222 without exchanging heat with water.

The refrigerant that has flowed into third high-pressure pipe 222 is blocked by refrigerant short-circuit mechanism 290 in the closed state and flows into air-cooling-type gas cooler 130 via refrigerant bypass pipe 223 and first refrigerant flow-rate adjusting mechanism 180.

The refrigerant that has flowed into air-cooling-type gas cooler 130 is cooled by exchanging heat with air and then flows into expansion mechanism 140 via fourth high-pressure pipe 224, second backflow preventing mechanism 171, and third high-pressure pipe 222.

Actions of the refrigerant thereafter are the same as those in Embodiment 1, and description thereof is thus omitted.

[3-3. Effects and the Like]

As described above, refrigeration device 100 in the present embodiment is a refrigeration device in which the refrigerant circuit is constituted by compression mechanism 110, water-cooling-type gas cooler 120 and air-cooling-type gas cooler 130 that cool the refrigerant that has been discharged from compression mechanism 110, expansion mechanism 140, and evaporator 150. The refrigeration device operates while switching a gas cooler to be used, and the circulation refrigerant amount in the refrigerant circuit is adjusted by collecting an excessive refrigerant into air-cooling-type gas cooler 130 during the water-cooling operation, in which water-cooling-type gas cooler 120 is used.

Consequently, it is possible to maintain a proper circulation refrigerant amount in the refrigerant circuit. It is thus possible to prevent an abnormal increase in the high-pressure-side pressure.

Other Embodiments

As an example of the technology disclosed in the present application, Embodiment 1 has been described as above. However, the technology disclosed in the present disclosure is not limited thereto and can be also applied to the embodiment in which modification, replacement, addition, omission, or the like has been performed. In addition, the components described in Embodiment 1 above can be combined together to form a new embodiment.

Hereinafter, other embodiments will be thus presented as examples.

In Embodiments 1 to 3, discharge pipe 210 has been described as one example of the attachment position of high-pressure-side pressure sensor 240. However, as long as high-pressure-side pressure sensor 240 can detect the refrigerant pressure on the high-pressure side during the water-cooling operation, high-pressure-side pressure sensor 240 may be provided at, for example, an inlet of third high-pressure pipe 222 or first refrigerant flow-rate adjusting mechanism 180. Therefore, the attachment position of high-pressure-side pressure sensor 240 is not limited to discharge pipe 210.

In Embodiments 1 to 3, the electronic expansion valve has been described as one example of first refrigerant flow-rate adjusting mechanism 180. However, as long as first refrigerant flow-rate adjusting mechanism 180 is a unit that can adjust the flow rate of a refrigerant that passes therethrough, for example, an electromagnetic valve may be used, and, the flow rate may be adjusted by pulse control. Therefore, first refrigerant flow-rate adjusting mechanism 180 is not limited to the electronic expansion valve.

In Embodiments 1 to 3, the electronic expansion valve has been described as one example of second refrigerant flow-rate adjusting mechanism 181. However, as long as second refrigerant flow-rate adjusting mechanism 181 is a unit that can adjust the flow rate of a refrigerant that passes therethrough, for example, an electromagnetic valve and a capillary tube may be combined together, and the flow rate may be adjusted by pulse control. Therefore, second refrigerant flow-rate adjusting mechanism 181 is not limited to the electronic expansion valve.

In Embodiments 1 and 2, the three-way electromagnetic valve has been described as one example of refrigerant-passage switching mechanism 160. However, as long as refrigerant-passage switching mechanism 160 is a unit that switches to cause the refrigerant that has been discharged from compression mechanism 110 to flow into water-cooling-type gas cooler 120 or to flow into air-cooling-type gas cooler 130, for example, an electromagnetic valve may be provided on the inlet side of each of water-cooling-type gas cooler 120 and air-cooling-type gas cooler 131, and the switching may be performed by bringing one of the electromagnetic valves into an opened state. Therefore, refrigerant-passage switching mechanism 160 is not limited to the three-way electromagnetic valve.

In Embodiments 1 to 3, the check valve has been described as one example of each of first backflow preventing mechanism 170 and second backflow preventing mechanism 171. However, as long as each of first backflow preventing mechanism 170 and second backflow preventing mechanism 171 is a unit that can prevent backflow of the refrigerant from the outlet side toward the inlet side, for example, an electromagnetic valve may be used and controlled to be in a closed state when the refrigerant pressure on the outlet side exceeds the refrigerant pressure on the inlet side. Therefore, each of first backflow preventing mechanism 170 and second backflow preventing mechanism 171 is not limited to the check valve.

In Embodiments 1 to 3, it has been described that the refrigerant that has flowed into air-cooling gas cooler 130 exchanges heat with the air around air-cooling gas cooler 130 through natural convection. However, heat exchange may be performed through forced convection by actuating a fan of air-cooling gas cooler 130 to accelerate the heat exchange.

In Embodiment 2, an intercooler that performs intercooling is omitted in a two-stage compression cycle. However, a water-cooling-type intercooler or an air-cooling-type intercooler, or both of them may be provided in accordance with characteristics of a refrigerant to be used and operation conditions to suppress an increase in the discharged gas temperature.

In addition, in Embodiment 1, carbon dioxide has been described as one example of the refrigerant to be used. However, the refrigerant to be used may be any medium for moving heat in a refrigeration cycle. Therefore, the refrigerant to be used is not limited to carbon dioxide.

Note that the embodiments described above are presented as examples of the technology in the present disclosure, and thus, various modification, replacement, addition, omission, and the like can be performed in the embodiments within the scope of the claims or a scope equivalent to the claims.

The disclosure of the specification, drawings, and abstract included in Japanese Patent Application No. 2022-004032, filed on Jan. 14, 2022, is incorporated herein by reference in its entirety.

INDUSTRIAL APPLICABILITY

The present disclosure is applicable to a device that effectively uses waste heat of a refrigeration device. Specifically, the present disclosure is applicable to a hot-water supplying device, a floor heating device, a warm-water room heater, an air conditioning device, and the like that use waste heat of a refrigeration device.

REFERENCE SIGNS LIST

100 Refrigeration device
110 Compression mechanism
111 Intake port
112 Discharge port
120 Water-cooling-type gas cooler
130 Air-cooling-type gas cooler
140 Expansion mechanism
150 Evaporator
160 Refrigerant-passage switching mechanism
170 First backflow preventing mechanism
171 Second backflow preventing mechanism
180 First refrigerant flow-rate adjusting mechanism
181 Second refrigerant flow-rate adjusting mechanism
190 Refrigerant pipe
200 Intake pipe
210 Discharge pipe
220 First high-pressure pipe
221 Second high-pressure pipe
222 Third high-pressure pipe
223 Refrigerant bypass pipe
224 Fourth high-pressure pipe
225 Injection pipe
230 Evaporator inlet pipe
231 Low-stage discharge pipe
240 High-pressure-side pressure sensor
260 Low-stage compression mechanism
261 Low-stage intake port
262 Low-stage discharge port
270 High-stage compression mechanism
271 High-stage intake port
272 High-stage discharge port
280 Intermediate-pressure pipe
290 Refrigerant short-circuit mechanism

The invention claimed is:

1. A refrigeration device that operates while switching a gas cooler to be used, the refrigeration device comprising:
- a refrigerant circuit that is constituted by a compression mechanism, a water-cooling-type gas cooler and an air-cooling-type gas cooler that cool a refrigerant that has been discharged from the compression mechanism, an expansion mechanism, and an evaporator, wherein
- a circulation refrigerant amount in the refrigerant circuit is adjusted by collecting an excessive refrigerant into the air-cooling-type gas cooler during a water-cooling operation in which the water-cooling-type gas cooler is used.

2. The refrigeration device according to claim 1, further comprising:
- a high-pressure-side pressure sensor that detects a refrigerant pressure on a high-pressure side of the refrigerant circuit, wherein
- the circulation refrigerant amount in the refrigerant circuit is adjusted by
  - performing, in response to an increase in the refrigerant pressure on the high-pressure side of the refrigerant circuit, a refrigerant collecting action in which a refrigerant is collected from the high-pressure side of the refrigerant circuit into the air-cooling-type gas cooler, and
  - performing, in response to a decrease in the refrigerant pressure on the high-pressure side of the refrigerant circuit, a refrigerant releasing action in which a refrigerant is released from the air-cooling-type gas cooler to a low-pressure side of the refrigerant circuit.

3. The refrigeration device according to claim 1, further comprising:
- a refrigerant bypass pipe that connects a connection pipe on a downstream side of the water-cooling-type gas cooler and a connection pipe on an upstream side or a downstream side of the air-cooling-type gas cooler to each other, wherein the circulation refrigerant amount in the refrigerant circuit is adjusted by performing the refrigerant collecting action via the refrigerant bypass pipe.

4. The refrigeration device according to claim 1, wherein:

the refrigeration device is a refrigeration device of a two-stage compression type comprising, as the compression mechanism, a low-stage compression mechanism and a high-stage compression mechanism, the refrigeration device comprises an intermediate-pressure pipe that connects the low-stage compression mechanism and the high-stage compression mechanism to each other and an injection pipe that connects a connection pipe on an upstream side or a downstream side of the air-cooling-type gas cooler and the intermediate-pressure pipe to each other, and the circulation refrigerant amount of the refrigerant circuit is adjusted by performing the refrigerant releasing action via the injection pipe.

5. The refrigeration device according to claim 1, wherein carbon dioxide is used as the refrigerant.

* * * * *